US010987603B2

(12) United States Patent
Noble

(10) Patent No.: US 10,987,603 B2
(45) Date of Patent: Apr. 27, 2021

(54) MALLEABLE BED COVER WITH ACCESSORIES

(71) Applicant: Ashley Noble, Bronx, NY (US)

(72) Inventor: Ashley Noble, Bronx, NY (US)

( * ) Notice: Subject to any disclaimer, the term of this patent is extended or adjusted under 35 U.S.C. 154(b) by 0 days.

(21) Appl. No.: 14/684,246

(22) Filed: Apr. 10, 2015

(65) Prior Publication Data

US 2015/0208836 A1 Jul. 30, 2015

(51) Int. Cl.
*A47C 29/00* (2006.01)
*A63H 33/00* (2006.01)
*A47G 9/02* (2006.01)

(52) U.S. Cl.
CPC ..... *A63H 33/00* (2013.01); *A47C 29/003* (2013.01); *A47G 9/02* (2013.01)

(58) Field of Classification Search
CPC ..... A47C 29/00; A47C 29/003; A47C 31/10; A47C 31/105; A47G 9/00; A47G 9/02; A47G 9/0238; E04H 15/324; A47D 15/00
USPC ..... D6/389, 597, 601, 610
See application file for complete search history.

(56) References Cited

U.S. PATENT DOCUMENTS 655,875 A * 8/1900 Johnson ..... E04H 15/18 135/123
668,543 A * 2/1901 Rawlings ..... E04H 15/38 135/132
739,352 A * 9/1903 Schuette ..... A47C 29/003 5/414
744,487 A * 11/1903 Childress ..... A47C 29/006 135/121
1,892,378 A * 12/1932 Bernstein ..... E04H 15/58 128/205.26
4,489,451 A * 12/1984 Neely ..... A47C 29/003 135/121
5,303,434 A * 4/1994 Arnold ..... A47D 7/00 135/138
5,930,854 A * 8/1999 O'Neill ..... A47D 13/063 135/135
6,371,144 B1 * 4/2002 Ragatz ..... E04H 15/06 135/115
6,578,214 B2 * 6/2003 Peftoulidis ..... A47C 17/86 5/2.1
6,601,250 B1 * 8/2003 Taylor ..... A47G 9/0238 5/482
8,413,269 B1 * 4/2013 Vail ..... A61G 7/0526 5/414
8,893,335 B1 * 11/2014 Hijuelos ..... A47C 31/105 5/113
2004/0016055 A1 * 1/2004 Lamy ..... A47G 9/02 5/485
2005/0045221 A1 * 3/2005 Forshpan ..... A47C 29/003 135/135

(Continued)

OTHER PUBLICATIONS

Dictionary.com, Definition of "integral", Sep. 14, 2020 (Year: 2020).*

*Primary Examiner* — Nicholas F Polito

(57) ABSTRACT

The present invention is a malleable bed cover that transforms a child's bed to resemble a predetermined object such as an automobile, train, boat, fort, airplane, castle, dollhouse, or a white blank cover to create a personalized design. The bed cover changes shape to provide the child with space for imagination play through the use of accessories, markers and attachable toys.

1 Claim, 7 Drawing Sheets

(56) References Cited

U.S. PATENT DOCUMENTS

| | | | | |
|---|---|---|---|---|
| 2006/0137729 | A1* | 6/2006 | Kline | A47C 21/08<br>135/96 |
| 2013/0291918 | A1* | 11/2013 | Lovell | A47C 29/003<br>135/151 |
| 2016/0242567 | A1* | 8/2016 | Lime | A47C 29/003 |

* cited by examiner

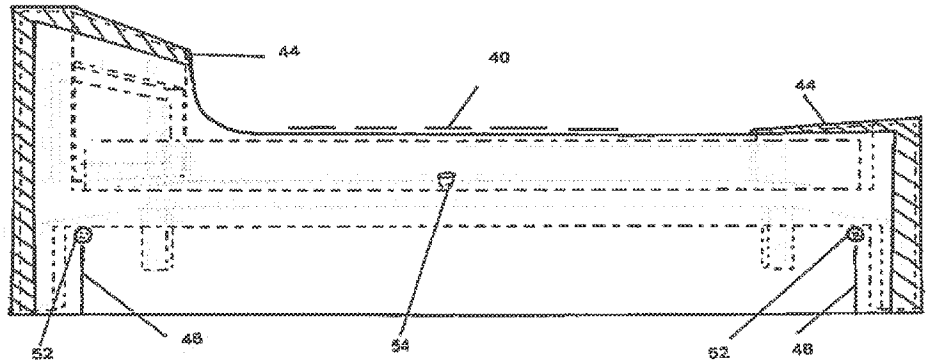
FIG. 2
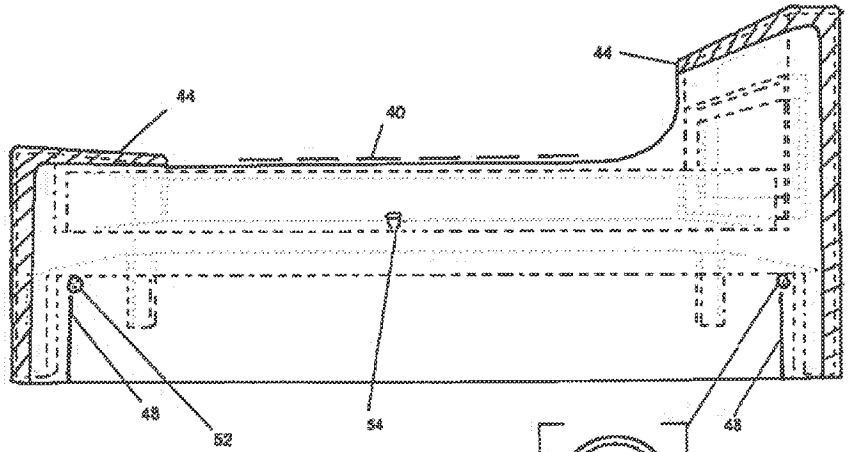
FIG. 3
FIG. 4

MALLEABLE BED COVER WITH ACCESSORIES

BACKGROUND OF THE INVENTION

Field of the Invention

This invention relates to bed accessories, and more particularly, to a cover for a child's bed and bed frame.

History

Beds are universal items of furniture which have been essentially unchanged in outward appearance for many years. Beds in the form of motor vehicles and the like were introduced in the early 1990s. They gained widespread popularity with children. Such beds and bed frames generally have the form of hard borders representing an automobile or the like. While such beds are popular with children, they are not completely safe and they usually require assembly and a vast amount of space.

On the other hand, conventional bedspreads have been utilized in order to decorate a bed. While bedspreads do not require assembly or a large amount of space, when placed on a bed, they do not realistically alter the bed to a simulated object.

Description to Related Art

Several devices have been developed, which involve a frame or a sleeping arrangement, such as those discussed.

Applicant believes that one of the closest reference corresponds to U.S. Pat. No. 8,893,335 issued to Hijuelos on Nov. 25, 2014 for Cover Bedding Set Assembly. However, it differs from the present invention because Hijuelos teaches a set assembly that transforms into predetermined shapes to disguise a bed. The assembly covers the bed and transforms it into defined shapes to resemble an automobile, train, boat, or plane. The assembly requires sidewalls, covers, hooks, and loop fasteners, which can be disassembled with tools.

Applicant believes that another reference corresponds to U.S. Pat. No. 8,321,980 issued to Maloney on Dec. 4, 2012 for Flexible System for Surrounding a Perimeter and Covering a Top Surface of a Mattress. However, it differs from the present invention because Maloney teaches a flexible system for surrounding a perimeter and covering a top surface of a mattress. The flexible system supports one or more appendage(s) of a character. The flexible system includes a textile or fabric frame for covering portions of a head side, a foot side, and intermediate sides of the mattress. The textile or fabric frame forms an opening around a portion of a top surface of the mattress, where the opening has an inner peripheral edge. The flexible system further includes a cover sheet positioned over the top surface, and having an outer peripheral edge that is attached to the inner peripheral edge of the opening of the frame. The appendage (s) of the character are supported on the textile or fabric frame at one or more of the head side, the foot side, and the intermediate sides of the mattress.

Applicant believes that another reference corresponds to U.S. Pat. No. 7,743,442 B2 issued to Maloney, et al. on Jun. 29, 2010 for System and Method for Enhancing the Safety of a Sleeping Arrangement for a Child on a Bed. However, it differs from the present invention because Maloney, et al. teaches a system for enhancing the safety of a sleeping arrangement for a child on a bed. The bed includes a mattress and box spring. The system includes a frame to enclose a perimeter of the mattress and the box spring. The frame includes a plurality of sections, which are attached at respective junctures with hook and loop fasteners. An outer surface of the frame is formed from plush material. The plurality of sections includes a pair of side sections, which extend along a respective pair of opposing side surfaces of the mattress and the box spring. The pair of side sections includes a respective vertical bumper configured to extend from a top portion of the side sections by a predetermined height, to prevent the child on the bed from passing outside the side surfaces of the mattress and falling from the mattress.

Applicant believes that another reference corresponds to U.S. Pat. No. 6,578,214 B2 issued to Peftoulidis on Jun. 17, 2003 for Sport Bed. However, it differs from the present invention because Peftoulidis teaches a bed comprising various sport-shaped bed designs consisting of a frame, mattress, motion sensors, rechargeable battery cell and dimmer night-light. The designs have shapes such as a football, baseball, soccer, basketball, and other sport shapes. The bed also comprises of storage drawers located in various positions according to the design. Each bed contains battery-operated motion sensors, which trigger a dimmer light. When the sensor indicates a child has lain down in the bed, the dimmer responds to the signal and the goes on. Within a short period of time, the light slowly dims until it is fully out. If the child should sit up the sensor will react and the light will go on. The mattress fits down inside a recess in the frame and the headboard.

Applicant believes that another reference corresponds to U.S. Pat. No. 5,044,024 issued to Del Rose on Sep. 3, 1991 for Bed with Covered Foot Portion. However, it differs from the present invention because Del Rose teaches a bed that resembles an automobile, with the foot portion covered to resemble the hood and dashboard of an automobile.

Applicant believes that another reference corresponds to U.S. Pat. No. 4,888,837 B1 issued to Wang on Dec. 26, 1989 for Toy Bed Transformers. However, it differs from the present invention because Wang teaches a toy bed transformer including a mattress and various inflatable toy accessories having shapes, such as, an airplane nose, an airplane wing, a cockpit, a rocket, a missile, a tire, a propeller, and a jet engine. The mattress and the inflatable toy accessories have attaching bands thereon and can be attached together by the attaching bands to form different objects mimicking for example, a car, an aircraft, and a tank, according to a child's own imaginative ideas.

Applicant believes that another reference corresponds to U.S. Pat. No. 4,765,006 issued to Jackson, et al. on Aug. 23, 1988 for Enclosure For Converting a Bed to a Play Area. However, it differs from the present invention because Jackson, et al. teaches the assembly of decorative paperboard to span the perimeter of a bed. This enclosure can be used around the perimeter of a bed or by itself as a play area.

Applicant believes that another reference corresponds to U.S. Pat. No. D275,912 issued to Hydrusko, et al. on Oct. 16, 1984 for Child's Bed. However, it differs from the present invention because Hydrusko, et al. teaches an ornamental design for a child's bed.

Applicant believes that another reference corresponds to U.S. Pat. No. D264,773 issued to Sutherland on Jun. 8, 1982 for Bed. However, it differs from the present invention because Sutherland teaches an ornamental design for a bed in the shape of a truck.

Applicant believes that another reference corresponds to U.S. Pat. No. 3,295,150 B1 issued to Shapiro, et al. on Jan.

3, 1967 for Decorative Bed Cover. However, it differs from the present invention because Shapiro, et al. teaches a decorative bed cover which, in combination with a bed, consists of bed-bed covering combination to realistically resemble an automobile.

Applicant believes that another reference corresponds to U.S. Pat. No. 3,266,063 B1 issued to Shapiro on Aug. 16, 1966 for Bedspread. However, it differs from the present invention because Shapiro teaches a bedspread, which, when placed upon a bed, causes the bed to resemble a three dimensional object of another type.

Applicant believes that another reference corresponds to U.S. Pat. No. 3,120,721 issued to Bukatman, et al. on Feb. 11, 1964 for Bedspread with Toy Devises. However, it differs from the present invention because Bukatman, et al. teaches a decorative bedspread which includes toy devises to be attached.

Applicant believes that another reference corresponds to U.S. Pat. No. D189,741 issued to Gatov on Feb. 14, 1961 for Child's Bed. However, it differs from the present invention because Gatov teaches an ornamental design for a child's bed in the shape of a truck.

Applicant believes that another reference corresponds to U.S. Pat. No. D147,942 issued to Ziegler on Nov. 18, 1947 for Bedstead. However, it differs from the present invention because Ziegler teaches an ornamental design for a bed that resembles an airplane.

Other patents describing the closest subject matter provide for a number of more or less complicated features that fail to solve the problem of space, assembly and safety in an efficient and economical way. None of these patents suggest the novel features of the present invention.

BRIEF SUMMARY OF THE INVENTION

In particular, the present invention relates to a bed cover adapted to resemble an object of the child's choosing. Designs include but are not limited to; an automobile, train, fort, castle, dollhouse, airplane, or white blank cover to create a personalized bed cover. The predetermined designs will have one side of the bed cover to show the external appearance of the chosen object while the other side, the internal appearance of the same object.

The bed cover is malleable to comfortably grip the bed frame. It has removable cushions to provide soft barriers on the edges of the bed frame to minimize injuries when bumped. The invention is easy to attach and remove. It adapts to serve as a toy and storage unit in a child's bedroom while stimulating the child's imagination.

The bed cover in the present invention, provides safety from injuries while effectively utilizing space and maintaining the realistic look of the simulated object. These advantages of the present invention will be readily apparent from the drawings and description which follows.

BRIEF DESCRIPTION OF THE SEVERAL VIEWS OF THE DRAWING

The invention consists in the details of construction and combination of parts as will be more fully understood from the following description. Understanding that these drawings depict only typical embodiments of the invention and are not therefore to be considered to be limiting of its scope, exemplary embodiments of the invention will be described and explained with additional specify and detail through the use of the accompanying drawings in which:

FIG. 2, is a view from the left side of the bed.

FIG. 3, is an enlarged image of button seen in FIGS. 1, 2, 4, 6, 9, 13 and 14.

FIG. 4, is a view from the right side of the bed.

FIG. 10, is an enlarged image of the side clip seen in FIGS. 1, 2, 4, and 9.

FIG. 11, is an enlarged image of the cylinder seen in FIGS. 1 and 7.

FIG. 12, is an enlarged image of the flexible rod.

DETAILED DESCRIPTION OF THE INVENTION

Figure 1:
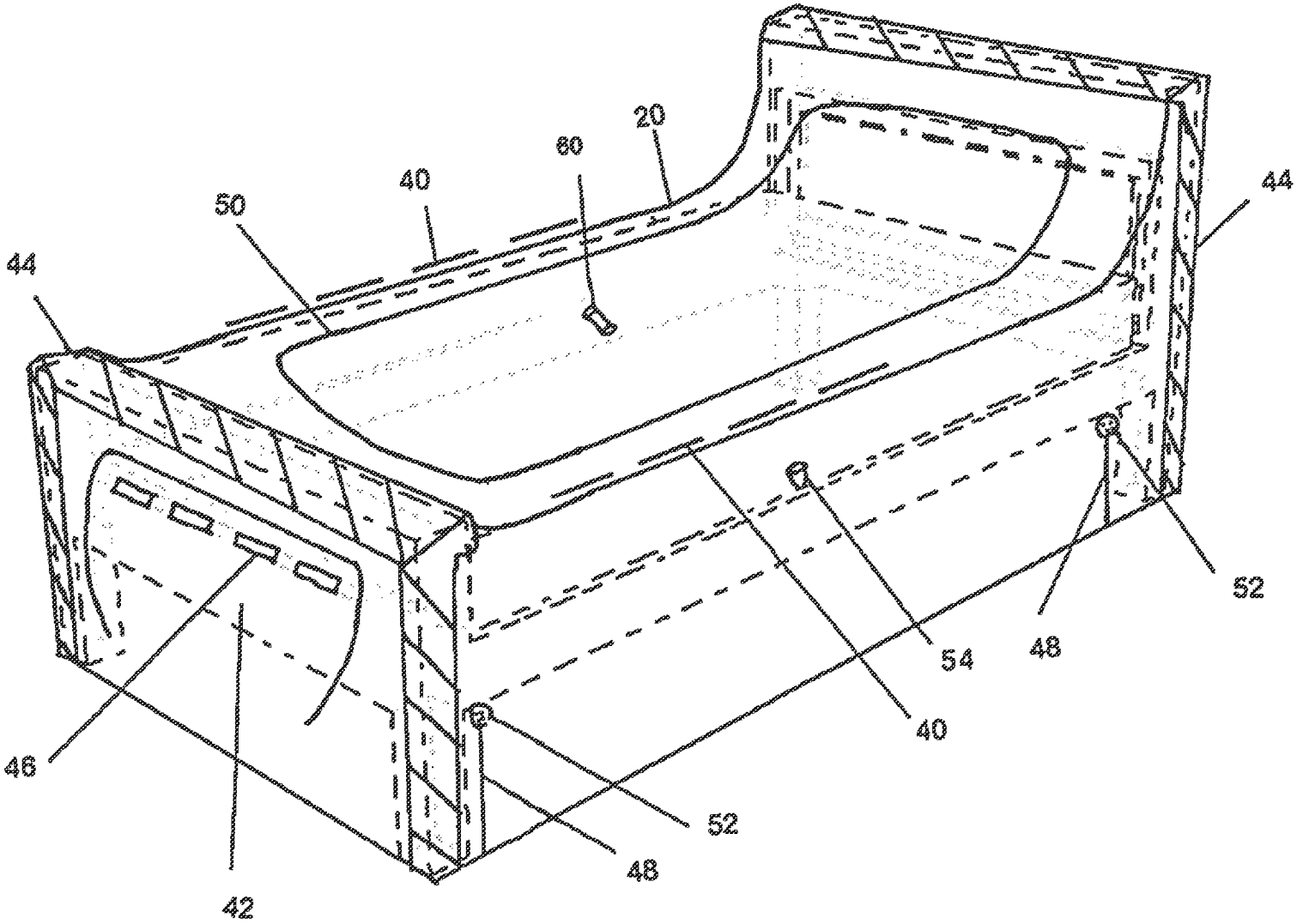
FIG. 1 is an isometric view of the bed.

The present invention is a malleable bed cover that transforms a child's bed to resemble an automobile, train, boat, fort, airplane, castle, dollhouse, or white blank cover to create a personalized cover. Accessories, markers, attachable toys and zippers will change the appearance of the cover while storage pockets will allow for additional storage.

The present invention relates to a bed accessory which, when placed on the bed, converts the bed to a predetermined object.

It is therefore one of the objects of the present invention to provide a malleable cover for a child's beds.

It is another object of this invention to provide the cover with zippers to allow for easy removal or attachment of bed rails.

It is another object of this invention to provide the cover with zippers to use for trundle bed access or for additional storage space.

It is another object of this invention to provide removable cushions to the corners of the bed cover to prevent injuries when bumped.

It is another object of this invention to provide a washable, durable material that will stretch over the bedframe without the need of any tools.

It is another object of this invention to provide a cover that alters the bed to resemble a predetermined object.

It is another object of this invention to provide the cover with accessories and attachable toys.

Further objects of the invention will be brought out in the following part of the specification, wherein the detailed description is for the purpose of fully disclosing the invention without placing limitations thereon.

Detailed Description of Preferred Embodiment

Referring now to the drawings, the present invention is generally referred to with numeral 20. It can be observed that the preferred embodiment is a cover that stretches over a child's bedframe.

Figures 8, 9:
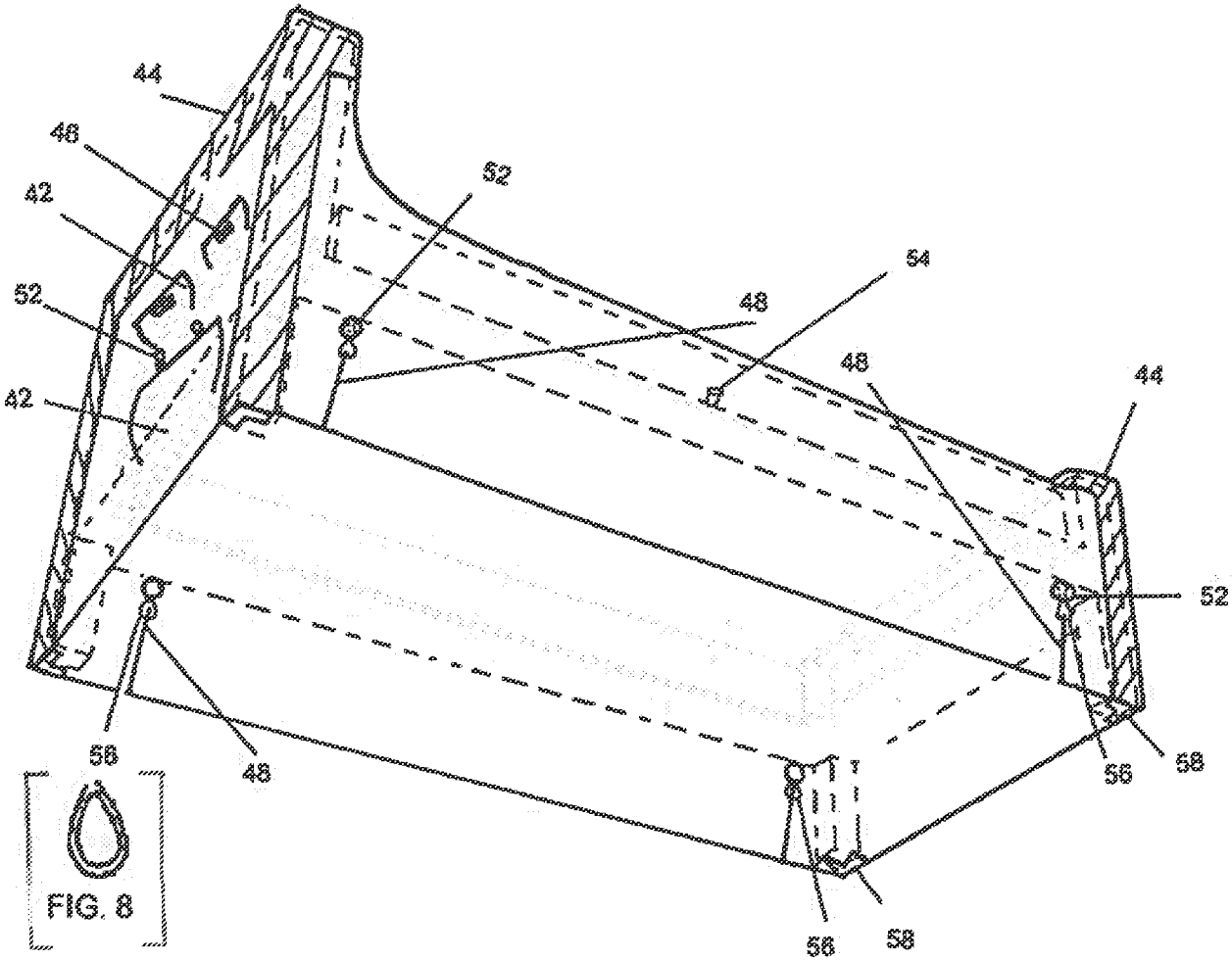
FIG. 8, is an enlarged image of the stretchy band.
FIG. 9, is a view from the bottom of the bed.

FIG. 1, comprises of malleable material 20, removable cushioned corners 44, zippers 48, and a removable mattress cover 50. The malleable cover 20 stretches over the bed frame as a fitted sheet would a mattress. Starting from one corner of the bed, pull the cover over the bedframe and work your way around the entire bedframe. Each corner 20 consists of removable cushions 44 to provide a barrier between the bedframe and child. The removable cushions 44 are on the top and sides of the headboard and footboard. They can be removed using openings at the bottom of 20, seen in FIG. 9. There are four zippers 48 towards the bottom of 20 near the side legs of the bedframe. These zippers 48 can be used to access underneath the bed for storage or to access a trundle bed. Buttons 52 and stretchy bands 56, seen in FIG. 8, are used to hold the material up while a trundle bed is in use. Once on the left side of the bed, unzip the zippers 48 and roll the material of 20 that sits between the zippers 48 on one side of the bed. The stretchy bands 56 wrap around the rolled up material of 20 and the buttons 52. The removable mattress cover 50 is used to expose or cover the mattress when sleeping or making up the bed. The mattress cover can be removed by unzipping 50 and taking it off the bed. Zippers 40 are shown as a dashed lines on the left and right side of 20. They are used for guard rails to prevent the child from falling out of the bed. FIG. 1, also consists of a storage compartment 42 on the footboard of the bed and hook and loop fastener 46 to keep 42 closed. This storage compartment 42 is on the outside of 20 and is easily accessible. The inside of 20, which is not visible to the eye, consists of side clips 54 on the left and right side of the bedframe as well as a flexible hollow cylinder 60 that sits on the mattress cover 50, in the middle of the side clips 54. These clips 54 and the cylinder 60 are used with a flexible rod, seen in FIG. 11, to lift the bed cover 20. When 20 is lifted, it resembles the simulated object and allows for additional playing space for the child.

As seen in FIG. 2 and FIG. 4, both sides of 20 comprises of two buttons 52, two zippers 48, a bed rail zipper 40, one side clip 54 and visibility of the removable cushions 44. FIG. 4 also consists of FIG. 3 which is an enlarged image of the button 52.

Figure 5:
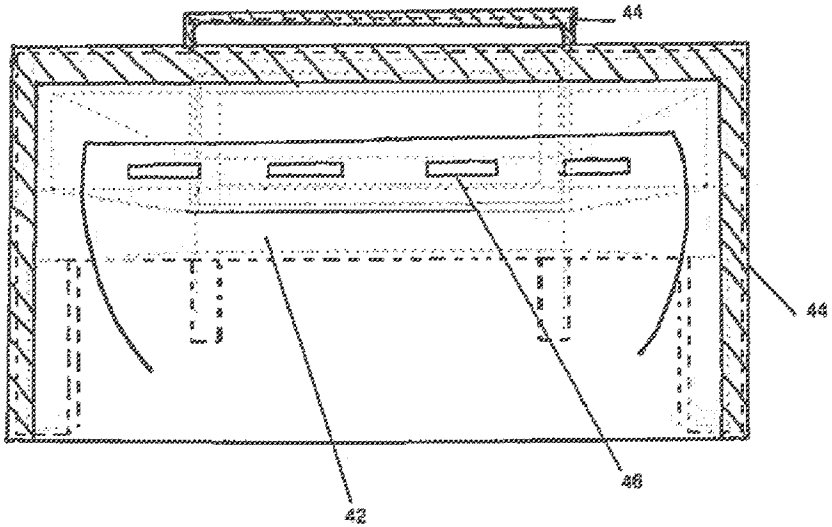
FIG. 5, is a view from the footboard of the bed.
Figure 6:
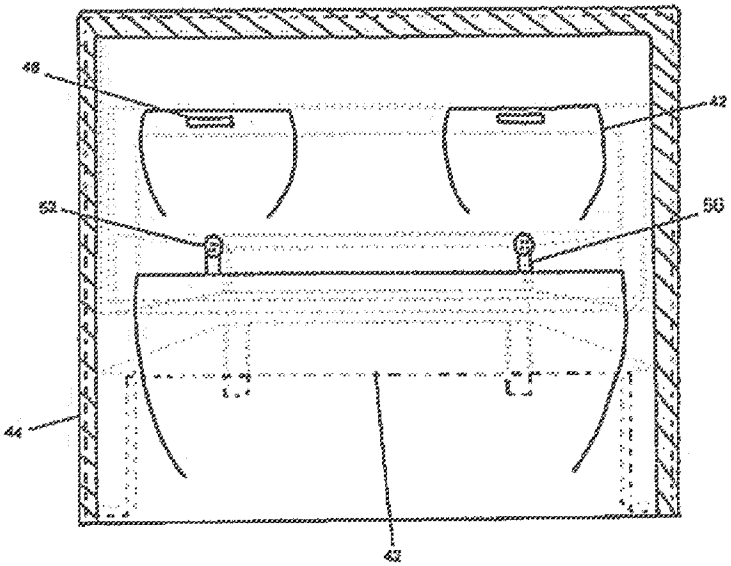
FIG. 6, is a view from the headboard of the bed.

FIG. 5 is a view from the footboard. It shows the storage compartment 42 and the hook and loop fastener 46 used to keep 42 closed. While FIG. 6 is a view of the headboard. It shows three storage compartments 42, wherein a large one is closed by two buttons 52 and two stretchy bands 56 and two smaller storage compartments 42 are closed by hook and loop fastener 46. The removable cushions 44 are seen in both figures.

Figure 7:
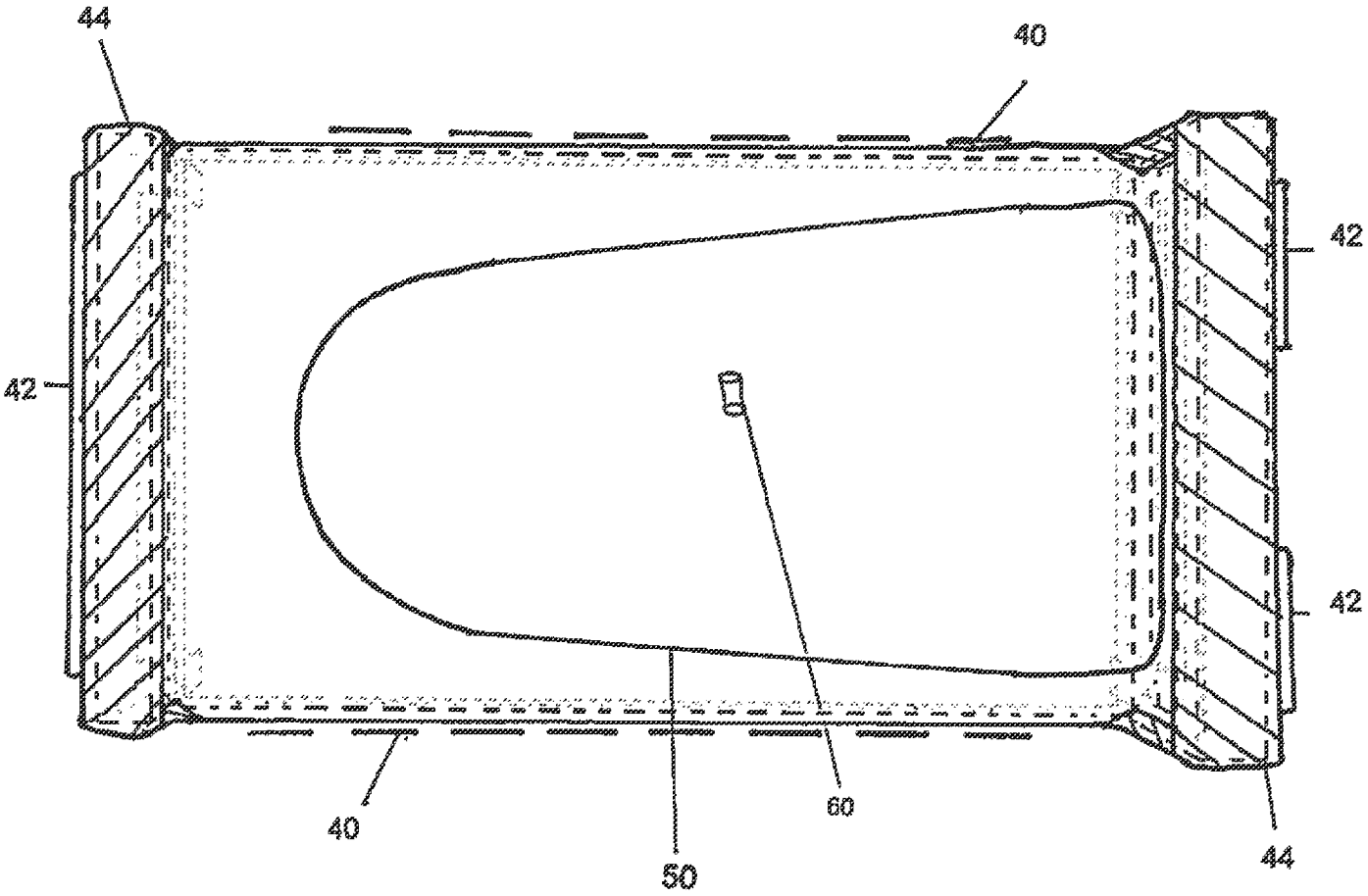
FIG. 7, is a view from the top of the bed.

FIG. 7 is the view from the top of the bed which shows the cylinder 60 which connects to the flexible rod in FIG. 11. The storage compartments 42, bed rail zippers 40, and the removable cushions 44 are also in view.

FIG. 9 shows the bed cover 20 from the bottom view. The storage compartments 42 from the headboard are shown as well as the hook and loop fastener 46 and buttons 52 that closes them. The buttons 52, zippers 48 and side clip 54 are shown on the left hand side. There are four stretchy bands 56 that work with the buttons 52 to hold the material 20 up on the sides of 20. They are shown behind the buttons 52 and above the zippers 48. There are two additional stretchy bands 56 on the headboard of 20. These wrap around the buttons 52 to keep the large storage compartment 42 closed. Lastly, there is an opening section of the material 58 is used to pull the removable cushion 44 from the material 20 shown in this figure. These are used when the cushion material 44 is no longer needed or wanted for the child's protection. The cushion material 44 slides through the openings 58 and can be replaced by pulling it back through the openings 58.

Figure 13:
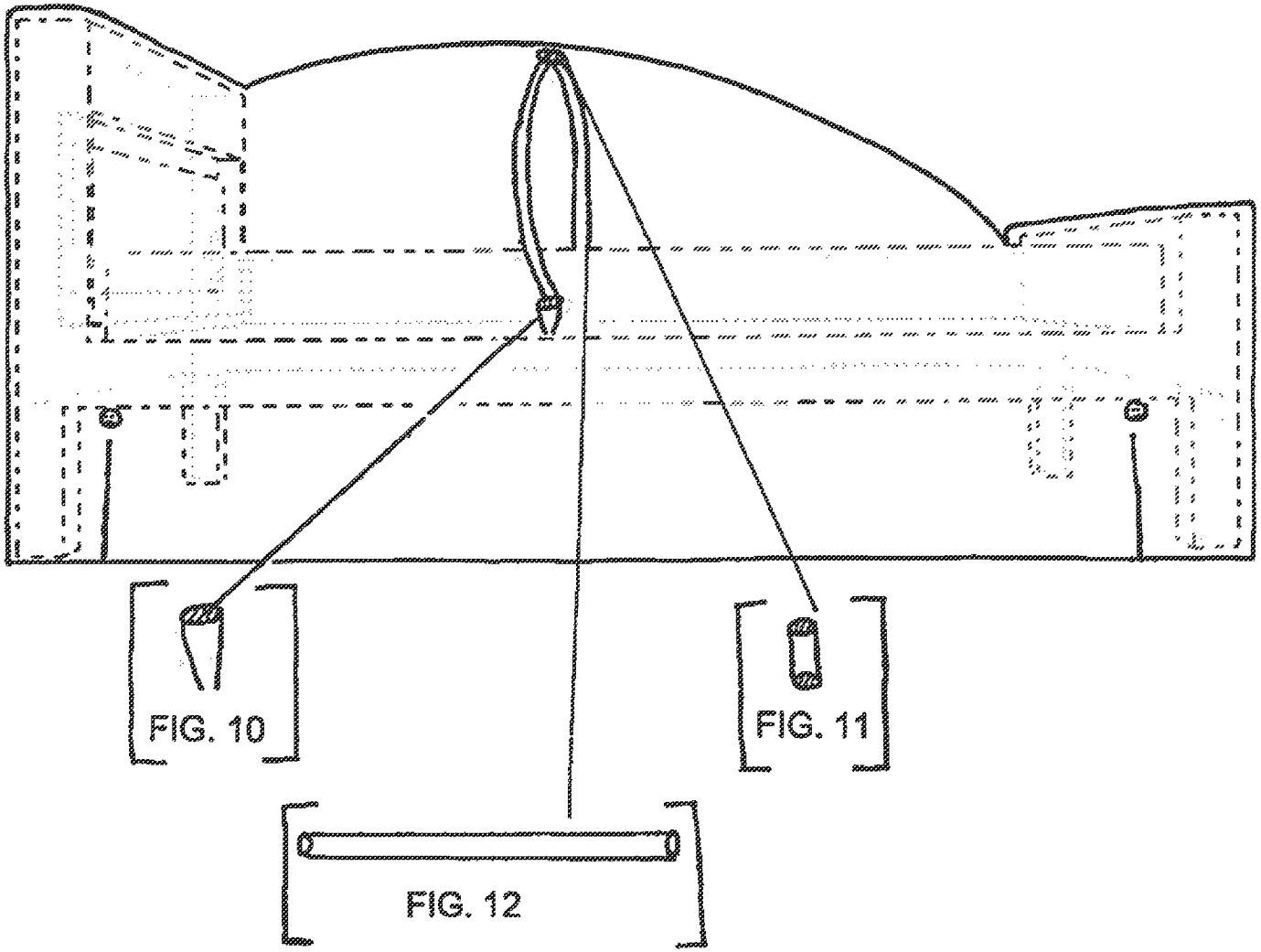
FIG. 13, is a view of the left side of the bed when the bed cover is lifted.
Figure 14:
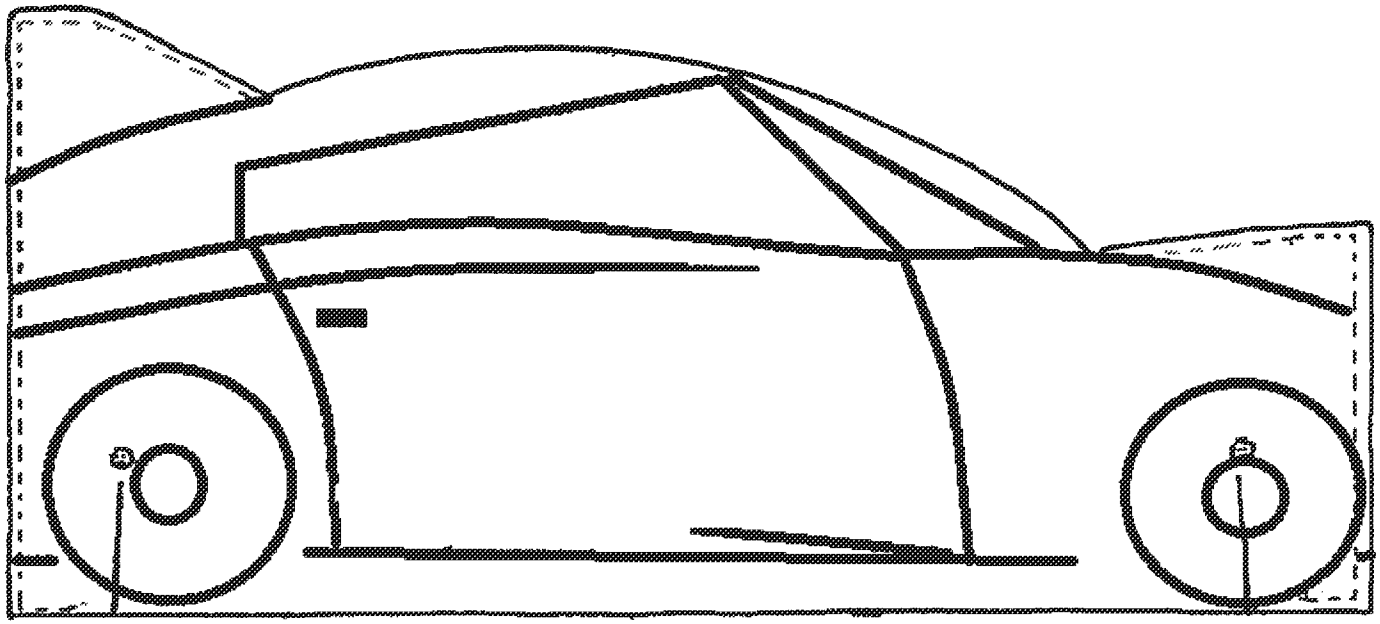
FIG. 14, is a view of a possible basic design for a bed cover.

FIG. 13, is a view of the flexible rod (FIG. 12), an exploded view of the side clips (FIG. 10) and an exploded view of the flexible hollow cylinder (FIG. 11). The flexible rod in FIG. 12 along with the side clips in FIG. 10 and cylinder in FIG. 11, will allow for more space to play on the bed cover 20. The flexible rod in FIG. 12 is optional and may not be necessary for the bed cover depending on the shape of the bedframe. When the flexible rod is in place, a bed cover in the design of a dollhouse will be taller and the top floors and rooms will be visible from the side view of the bed or the windows and roof of an automobile design will be visible from the side view of the bed. To illustrate this in a basic design, FIG. 14, is a view of a bed cover with a simple automobile design. It is from the side of the bed that shows the external view of the object. The internal view of the object would be on the other side of the bed. It would show everything under the hood, the seats, the dashboard and the trunk of the car. It would essentially be a detailed x-rayed version of the car. It would include plush toys that stick to the material, such as tools, car mats, a steering wheel, and a spare tire. It would also include markers and stickers. These accessories and toys will allow the child to use his/her imagination to turn their bed cover into a large toy.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

REFERENCES CITED

U.S. Patent Documents

20160242567-A1*08/2016 Lime . . . 1/1
20130291918-A1*11/2013 Lovell . . . 135/151
20050045221-A1*03/2005 Forshpan . . . 135/135
20040016055-A1*01/2004 Lamy . . . 5/485
U.S. Pat. No. 8,893,335-B1*11/2014 Hijuelos . . . 5/113
U.S. Pat. No. 8,413,269-B1*04/2013 Vail . . . 5/414
U.S. Pat. No. 6,578,214-B2*06/2003 Peftoulidis . . . 5/2.1
20060137729-A1*06/2006 Kline . . . 135/96
U.S. Pat. No. 5,303,434-A*04/1997 Arnold . . . 135/138
U.S. Pat. No. 1,892,378-A*12/1932 Edith Bernstein Sarah . . . 128/205.26
U.S. Pat. No. 4,489,451* 12/1984 Neely . . . 135/121
U.S. Pat. No. 5,930,854-A*08/1999 O'Neill . . . 135/135

What is claimed:

1. A decorative cover for a bed frame, the bed frame having a head board, a foot board, a first side rail, and a second side rail, the decorative cover comprising:

a removable head board cushion configured to cover a top and sides of the head board;

a removable foot board cushion configured to cover a top and sides of the foot board;

a stretchable cover comprising a head board portion, a foot board portion, a first side portion, a second side portion, a top portion, and a bottom portion, and;

a flexible rod configured to lift the top portion of the flexible cover;

wherein the head board portion includes at least one first storage compartment and is configured to be pulled over the head board when the removable head board cushion is covering the head board;

wherein the foot board portion includes at least one second storage compartment and is configured to be pulled over the foot board when the removable foot board cushion is covering the foot board;

wherein the first side portion includes a first side clip configured to clip onto the first side rail, and at least one first zipper configured to permit access to a trundle bed or under bed storage;

wherein the second side portion includes a second side clip configured to clip onto the second side rail, and at least one second zipper configured to permit access to a trundle bed or under bed storage;

wherein the top portion includes at least one third zipper configured to permit removal or attachment of at least one guard rail, and a removable mattress cover having a hollow cylinder;

wherein the bottom portion includes at least one opening configured to allow removal or replacement of the head board cushion and the foot board cushion there through; and wherein the flexible rod is configured to connect with the first side clip, the second side clip, and the hollow cylinder.

* * * * *